US006082317A

United States Patent [19]

Takahashi et al.

[11] Patent Number: 6,082,317

[45] Date of Patent: Jul. 4, 2000

[54] VALVE SEAT FOR INTERNAL COMBUSTION ENGINE

[75] Inventors: Teruo Takahashi; Toshiaki Sato, both of Shimotsuga-gun, Japan

[73] Assignee: Nippon Piston Ring Co., Ltd., Tokyo-to, Japan

[21] Appl. No.: 09/104,360

[22] Filed: Jun. 25, 1998

[30] Foreign Application Priority Data

Jun. 27, 1997 [JP] Japan ..... 9-187701

[51] Int. Cl.[7] ..... F01L 3/00

[52] U.S. Cl. ..... 123/188.8; 123/188.3

[58] Field of Search ..... 123/188.3, 188.8

[56] References Cited

U.S. PATENT DOCUMENTS

| | | | |
|---|---|---|---|
| 3,876,475 | 4/1975 | Ramqvist | 420/38 |
| 4,224,060 | 9/1980 | de Souza et al. | 340/514 |
| 4,424,953 | 1/1984 | Takagi et al. | 251/368 |
| 4,844,024 | 7/1989 | Fujiki et al. | 123/188.8 |
| 4,964,908 | 10/1990 | Greetham | 75/241 |
| 5,674,449 | 10/1997 | Liang et al. | 420/12 |
| 5,784,681 | 7/1998 | Purnell et al. | 419/11 |
| 5,834,664 | 11/1998 | Aonuma et al. | 75/246 |

FOREIGN PATENT DOCUMENTS

| | | |
|---|---|---|
| 5-43913 | 2/1993 | Japan . |
| 5-43998 | 2/1993 | Japan . |

*Primary Examiner*—Noah P. Kamen
*Assistant Examiner*—Hai Huynh
*Attorney, Agent, or Firm*—Nixon & Vanderhye

[57] ABSTRACT

A valve seat for an internal combustion engine is provided with a base member in which cobalt-based hard particles are dispersed in a matrix of an iron-based alloy. The matrix of an iron-based alloy comprises (a) carbon in a range of 0.5–1.5 weight %, (b) chromium and/or vanadium in a range of 0.5–10.0 weight % in total and (c) iron as a remainder based on weight of the base member respectively. An amount of the cobalt-based hard particles is in a range of 26–50 weight % based on weight of the base member.

8 Claims, 5 Drawing Sheets

VALVE SEAT FOR INTERNAL COMBUSTION ENGINE

FIELD OF THE INVENTION

The present invention relates to a valve seat to be used for an internal combustion engine.

BACKGROUND OF THE INVENTION

Many kinds of valve seats including one made of an iron-based sintered alloy have hitherto been used in internal combustion engines such as an automobile engine, and studies have been made as to wear and abrasion resistance of the valve seats.

In general, an engine using a kind of liquid fuels such as gasoline and gas oil is advantageous to reduction of the wear and abrasion of the valve seat, because of maintenance of high lubricity between a valve and the valve seat through the fuel and combustion products including carbon. To the contrary, an operation of an engine using a kind of gaseous fuels such as natural gas involves metallic surfaces of the valve seat and the valve in a direct contact with each other, because an amount of combustion products is small in comparison with a case where the liquid fuel is used, and hence tends to develop the wear and abrasion, resulting in occurrence of a flow caused by plastic deformation and an adhesive wear and abrasion.

As to a method to improve the wear and abrasion resistance of the valve seat, there is known that hard particles such as Fe-Mo particles or Fe-W particles are dispersed in a matrix of the valve seat. However, when the wear and abrasion resistance of the valve seat is intended to be improved by increasing an amount of the hard particles, the valve which is a counterpart used in combination therewith is liable to be worn and/or abraded.

There have been disclosed some valve seats having an excellent wear and abrasion resistance and a small attacking property against the counterpart. For example, Japanese Patent Application Laid Open (KOKAI) No. HEI 5-43913 discloses a valve seat of iron-based sintered alloy formed by the method in which carbide-dispersed type and/or intermetallic compound-dispersed type hard particles having a Micro Vickers hardness in a range of 500–1800 are dispersed in an amount of 5–25 weight % in the matrix of iron-based sintered alloy, and the shape of the hard particle is made globular. Besides, Japanese Patent Application Laid Open (KOKAI) No. HEI 5-43998 discloses another valve seat of iron-based sintered alloy formed by the method in which carbide-dispersed type and/or intermetallic compound-dispersed type hard particles having a Micro Vickers hardness in a range of 500–1800 are dispersed in an amount of 5–25 weight % in the matrix of iron-based sintered alloy to form a base member of the valve seat, and thus formed base member is infiltrated with copper or copper alloy. In the aforesaid publications, however, there is no investigation regarding a countermeasure in case where the valve seat is brought into direct contact with a metallic surface of a counterpart, as in the engine using the gaseous fuel.

SUMMARY OF THE INVENTION

The present invention was made in order to solve the aforementioned problems. An object of the present invention is to provide a valve seat capable of maintaining an excellent wear and abrasion resistance and a small attacking property against the counterpart, even when it is used in a severe condition, such as a condition which leads easy occurrence of direct contact between a metallic surfaces of a valve and the valve seat, as used for example, in an engine using the gaseous fuel.

According to the present invention, for the purpose of achieving the aforementioned object, there is provided a valve seat for an internal combustion engine provided with a base member, wherein said base member comprises;

a matrix of an iron-based alloy comprising (a) carbon in a range of 0.5–1.5 weight %, (b) at least one element selected from a group consisting of chromium and vanadium in a range of 0.5–10.0 weight % in total and (c) iron as a remainder of said matrix based on weight of said base member respectively, and cobalt-based hard particles dispersed in said matrix in a range of 26–50 weight % based on weight of said base member.

Because the cobalt-based hard particles used in the present invention differ from the conventional hard particles (i.e., Fe-Mo hard particles, Fe-W hard particles and the like) in that they have a small attacking property against a counterpart and a self-lubricity in comparison with the conventional hard particles, it is possible to control the attacking property against the counterpart within a low level even when the cobalt-based hard particles are dispersed in the base member of the valve seat in a large amount of 26–50 weight %. Therefore, the valve seat according to the present invention is able to maintain an excellent wear and abrasion resistance and a small attacking property against the counterpart even in severe operating conditions, particularly, in a condition which easily causes the direct contact between the metallic surfaces of the valve and the valve seat, as used in the engine using the gaseous fuel.

DETAILED DESCRIPTION OF THE PREFERRED EMBODIMENTS

Figure 1:
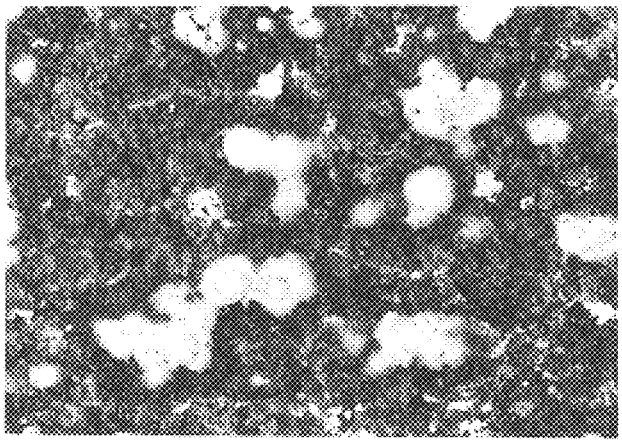
FIG. 1 is a photograph showing a metallographic structure of a valve seat obtained in Example 3 of the present invention.

An embodiment of the present invention will be described hereinafter. A valve seat of the present invention is provided with a base member as a main body. The base member has a metallographic structure comprising a matrix of iron-based alloy and cobalt-based hard particles dispersed in the matrix. Essential components of the matrix are (a) carbon[C], (b) chromium[Cr] and/or vanadium[V], and (c) iron[Fe]. An amount ratio of each aforementioned component on the basis of the whole weight of the base member is as follows.

(1) The amount of carbon defined as the component of the matrix is in a range of from 0.5 to 1.5 weight %, and it is preferable to limit a lower limit thereof to not less than 0.8 weight % and an upper limit thereof to not more than 1.2 weight %.

(2) The total amount of chromium and vanadium respectively defined as the component of the matrix is in a range of from 0.5 to 10.0 weight %, and it is preferable to limit a lower limit thereof to not less than 2.0 weight % and an upper limit thereof to not more than 7.0 weight %.

(3) The amount of the cobalt-based hard particles is in a range of from 26 to 50 weight %, and it is preferable to limit a lower limit thereof to not less than 30 weight % and an upper limit thereof to not more than 40 weight %.

(4) A remainder of the base member is iron defined as the component of the matrix. For all that, the remainder may include unavoidable impurities.

As to the amount of carbon defined as the component of the matrix, if the amount of carbon is smaller than 0.5 weight %, free ferrite may be precipitated in the matrix, thus causing an obstruction to the wear and abrasion resistance. Besides, when the base member is formed of iron-based sintered alloy, the excessively small amount of carbon may cause an insufficient diffusion during sintering process. On the other hand, if the amount of carbon is larger than 1.5 weight %, free cementite may be precipitated in the matrix, causing a deterioration of machinability during cutting process.

As to the total amount of chromium and vanadium respectively defined as the component of the matrix, if the total amount of them is smaller than 0.5 weight %, there may be caused an insufficient strengthening of the matrix or an insufficient heat resistance thereof. On the other hand, if the aforesaid total amount is larger than 10.0 weight %, there may be caused a deterioration of compactibility, thus resulting in a deterioration of strength.

As to the amount of the cobalt-based hard particles, if its amount is smaller than 26 weight %, the cobalt-based hard particles could not sufficiently contribute to improvement of the wear and abrasion resistance. Particularly, in a case where the metallic surfaces of the valve and the valve seat is mostly brought into direct contact with each other, for example, in a case of the engine using alternative fuels such as natural gas, the wear and abrasion resistance is liable to be insufficient by the excessively small amount of the cobalt-based hard particles. On the other hand, if the amount of the cobalt-based hard particles is larger than 50 weight %, bonding strength between the particles may be decreased, and besides, the cost for the production of the valve seat is raised.

The cobalt-based hard particles used in the present invention are an intermetallic compound, which contain cobalt as a main component and another element (for example, molybdenum [Mo], chromium [Cr] and nickel [Ni]) capable of improving the heat resistance and/or the corrosion resistance, and have a Vickers hardness of not less than Hv 500, preferably not less than Hv 700. A mean particle size of the cobalt-based hard particles is usually in a range of from 50 to 200 $\mu$m, preferably in a range of from 100 to 150 $\mu$m. The cobalt-based hard particles preferably have globular shapes. Concrete product names of the aforesaid cobalt-based hard particles may include "TRIBALOY T-400" and "TRIBALOY T-800" manufactured by NIKKOSHI Co., Ltd. respectively.

In addition to the essential components described above, there may be added (d) one or more kind of elements selected from a group consisting of nickel[Ni], cobalt[Co] and molybdenum[Mo] as the components of the matrix. The elements of the group (d) are used for a main purpose of the strengthening of the matrix or the improvement of the heat resistance like the Cr and V which are the elements of the group (b).

The total amount of nickel, cobalt and molybdenum as the components of the matrix is in a range of from 2.0 to 20.0 weight % on the basis of the whole weight of the base member, and it is preferable to limit a lower limit thereof to not less than 5.0 weight % and an upper limit thereof to not more than 15 weight %. If the total amount of them is smaller than 2.0 weight %, there may be caused an insufficient strengthening of the matrix or an insufficient heat resistance thereof. On the other hand, if the aforesaid total amount is larger than 20.0 weight %, retained austenite may be formed, and besides, the cost for the production of the valve seat is raised.

One or more kinds of self-lubricating materials may also be dispersed in the base member of the valve seat. Addition of the self-lubricating material prevents the metallic surface of the valve seat from being brought into direct contact with the metallic surface of the valve, making it possible to improve the wear and abrasion resistance and the attacking property against the counterpart furthermore. Examples of the self-lubricating materials may include; sulfides such as MnS and $MoS_2$; fluorides such as $CaF_2$; nitrides such as BN; and graphite. An amount of the self-lubricating material is usually in a range of from 0.5 to 10 weight %, preferably in a range of from 2 to 5 weight %, based on the whole weight of the base member. If the amount thereof is smaller than 0.5 weight %, the self-lubricating material can not sufficiently contribute to improvement of the self-lubricity. On the other hand, a content thereof is larger than 10 weight %, the wear and abrasion resistance is liable to be deteriorated due to a decrease in bonding strength between the particles and a decrease in strength of the base member.

In the valve seat according to the present invention, the matrix of the base member may be formed of iron-based sintered alloy. When the valve seat is intended to be formed of the iron-based sintered alloy, a hardening or quenching treatment can optionally be omitted. In this case, as powdery raw material for the matrix, there may be used; for example, powder of the iron-based alloy containing one or more elements of the aforementioned components for the matrix such as C, Cr, V, Ni, Co and Mo; mixed powder mainly containing the powder of the iron-based alloy; or non-alloyed powder which is prepared by blending pure-iron powder and powders of the elements for the components of the matrix other than iron.

When the matrix is formed of the sintered alloy, it has a metallographic structure in which a pearlite phase , a martensite phase and a highly alloyed phase are messily concurrent with each other.

According to the present invention, the aforementioned "highly alloyed phase" is a portion of an austenite phase in which the components for the matrix such as C, Cr, V, Ni, Co and Mo diffuse at a high concentration, and which has a high hardness, preferably in a range of from Hv 500 to Hv 700. As to an amount ratio of each phase to the matrix, there can be expressed by an area ratio based on an area of the matrix portion in a cross section of the base member. When the area of the matrix portion given by subtracting an area of the hard particles portion from the whole cross section of the base member is defined as 100% by area, the area ratio of each phase is as follows; the portion of the pearlite phase being in a range of from 5 to 15%, the portion of the martensite phase being in a range of from 30 to 60%, and the portion of the highly alloyed phase being in a range of from 30 to 60%; and preferably, the portion of the pearlite phase being in a range of from 5 to 10%, the portion of the martensite phase being in a range of from 40 to 50%, and the portion of the highly alloyed phase being in a range of from 40 to 50%.

When the base member of the valve seat is formed of the sintered alloy, any metal having a low melting point may be infiltrated into pores of the base member. Because the thus infiltrated metal having a low melting point interposes between the valve and the valve seat to function as a lubricant, it prevents the direct contact between the metallic surfaces of the valve and the valve seat, thus imparting the improved wear and abrasion resistance and the small attacking property against the counterpart to the valve seat. Examples of the metal having a low melting point may include lead[Pb], zinc[Zn], tin[Sn], copper[Cu] and an alloy containing at least one element selected from those.

The sintered alloy usually has a porosity in a range of from 2 to 20%, preferably in a range of from 5 to 10%. If the porosity is smaller than 2%, an amount of the infiltrated metal may be insufficient. On the other hand, if the porosity is larger than 20%, the wear and abrasion resistance is liable to be deteriorated due to the decrease in bonding strength between the particles and the decrease in strength of the base member.

TABLE 1 shows a chemical composition of one embodiment of the valve seat according to the present invention. The chemical composition of TABLE 1 is that of the base member obtained after the Pb-infiltration, more specifically, obtained by forming the base member of iron-based sintered alloy from the raw material for the matrix and the cobalt-based hard particles, and subsequently infiltrating lead[Pb] into the base member. The chemical composition showed in TABLE 1 is out of accord with a chemical composition of the matrix permitted in the present invention, because the components contained in the cobalt-based hard particles effect on the chemical composition.

TABLE 1

| Element of Component | Chemical Composition (wt. %) |
|---|---|
| C | 0.5–1.5 |
| Si | 0.2–2.0 |
| Cr | 1.0–10.0 |
| Mo | 5.0–20.0 |
| Ni | 2.0–10.0 |
| Co | 10.0–45.0 |
| Pb | 5.0–20.0 |
| V | 0.1–5.0 |
| Unavoidable Components | Not More Than 2.0 |
| Fe | Remainder |

EXAMPLES

Now, the present invention will be described hereinafter in more detail with reference to Experiment Examples and Comparative Examples.

Example 1

Experiment Example

The following powders or materials were respectively taken out to prepare a powdery raw material.

(1) An iron based low-alloyed powder which contained not more than 0.10 wt. % of C, not more than 0.30 wt. % of Mn, 3.0 wt. % of Cr and the remainder of Fe, based on the weight of the iron based and low-alloyed powder respectively, (2) Carbon[C], (3) Cobalt-based hard particles ("TRIBALOY T-800" manufactured by NIKKOSHI Co., Ltd. ), which contained not more than 0.08 wt. % of C, 28.5 wt. % of Mo, 17.5 wt. % of Cr, 3.4 wt. % of Si and the remainder of Co, respectively based on the weight of the cobalt-based hard particles, and, (4) Zinc stearate as a lubricant.

The carbon, the cobalt-based hard particles and zinc stearate were added into the iron based low-alloyed powder, and the obtained mixture was subsequently subjected to a mixing treatment by means of a V-shaped mixer for 10 minutes, thus obtaining the powdery raw material. An mount ratio on the basis of the whole weight of the resultant powdery raw material was as follows: 1.0 wt. % of carbon, 40.0 wt. % of the cobalt-based hard particles and 1.0 wt. % of zinc stearate.

Then, the aforesaid powdery raw material was subjected to a compression molding so as to obtain a green compact having a shape of the valve seat by means of an oil hydraulic press machine. Thereafter, the thus obtained green compact was subjected to a sintering treatment by means of a vacuum furnace at 1160° C. for 30 minutes, and it was subsequently cooled at a cooling rate of 400° C./hour, whereby manufacturing a valve seat formed of the sintered alloy.

Example 2

Experiment Example

A valve seat of the sintered alloy was manufactured in the same manner as in EXAMPLE 1 except that the iron based low-alloyed powder having the following composition was used: not more than 0.10 wt. % of C, not more than 0.30 wt. % of Mn, 2.0 wt. % of V and the remainder of Fe.

Example 3

Experiment Example

A valve seat of the sintered alloy was manufactured in the same manner as in EXAMPLE 1 except that the iron based low-alloyed powder having the following composition was used: not more than 0.10 wt. % of C, not more than 0.30 wt. % of Mn, 3.0 wt. % of Cr, 2.0 wt. % of V and the remainder of Fe.

Example 4

Experiment Example

The following powders or materials were respectively taken out to prepare a powdery raw material.

(1) An iron based low-alloyed powder which contained not more than 0.10 wt. % of C, not more than 0.30 wt. % of Mn, 3.0 wt. % of Cr, 2.0 wt. % of V and the remainder of Fe, based on the weight of the iron based low-alloyed powder respectively, (2) Carbon[C], (3) Nickel[Ni], (4) Cobalt[Co], (5) Molybdenum[Mo], (6) Cobalt-based hard particles ("TRIBALOY T-800" manufactured by NIKKOSHI Co., Ltd. ), which contained not more than 0.08 wt. % of C, 28.5 wt. % of Mo, 17.5 wt. % of Cr, 3.4 wt. % of Si and the remainder of Co, based on the weight of the cobalt-based hard particles respectively, and, (4) Zinc stearate as a lubricant.

Into the iron based low-alloyed powder, all of another powders or materials were added, and the obtained mixture was subsequently subjected to a mixing treatment by means of a V-shaped mixer for 10 minutes, thus obtaining the powdery raw material. An mount ratio on the basis of the whole weight of the resultant powdery raw material was as follows: 1.0 wt. % of C, 6.0 wt. % of Ni, 4.0 wt. % of Co, 2.0 wt. % of Mo, 30.0 wt. % of the cobalt-based hard particles and 1.0 wt. % of zinc stearate.

Then, a valve seat of the sintered alloy was manufactured in the same manner as in EXAMPLE 1 except that the aforesaid powdery raw material was used.

Examples 5 to 8

Experiment Examples and Examples 9 to 13

COMPARATIVE EXAMPLES

The valve seat of each examples was manufactured in the same manner as in EXAMPLE 4 except that the kind and the amount of the hard particles were changed, and $CaF_2$ or MnS as the self-lubricating material was added into the powdery raw material as occasion demands. In EXAMPLE 9, the iron based low-alloyed powder was not used. Besides, in EXAMPLE 8, a sintered compact obtained through the sintering and cooling process was placed in a vacuum vessel so that air was discharged from pores of the sintered compact, thereafter, the sintered compact was dipped into fused Pb and was put under pressure to be infiltrated with Pb as the self-lubricating material, whereby manufacturing the valve seat. Components and an amount of each of them are shown in TABLE 2 below.

TABLE 2

| | Composition (weight %) | | | | | | | | | | |
|---|---|---|---|---|---|---|---|---|---|---|---|
| | Component of Matrix | | | | | | | | | | |
| | | | | | Low Alloyed Powder | | | Hard | | Self- | |
| No. | C | Ni | Co | Mo | Cr | V | Fe | Particle | | Lubricant | |
| Experiment Examples | | | | | | | | | | | |
| 1 | 1.0 | — | — | — | 3.0 | — | remainder | Co-based | 40 | non | — |
| 2 | 1.0 | — | — | — | — | 2.0 | remainder | Co-based | 40 | non | — |
| 3 | 1.0 | — | — | — | 3.0 | 2.0 | remainder | Co-based | 40 | non | — |
| 4 | 1.0 | 6.0 | 4.0 | 2.0 | 3.0 | 2.0 | remainder | Co-based | 30 | non | — |
| 5 | 1.0 | 6.0 | 4.0 | 2.0 | 3.0 | 2.0 | remainder | Co-based | 40 | non | — |
| 6 | 1.0 | 6.0 | 4.0 | 2.0 | 3.0 | 2.0 | remainder | Co-based | 40 | CaF2 | 3 |
| 7 | 1.0 | 6.0 | 4.0 | 2.0 | 3.0 | 2.0 | remainder | Co-based | 40 | MnS | 2 |
| 8 | 1.0 | 6.0 | 4.0 | 2.0 | 3.0 | 2.0 | remainder | Co-based | 40 | Pb infiltration | |
| Comparative Examples | | | | | | | | | | | |
| 9 | 1.0 | — | — | — | — | — | remainder | Co-based | 40 | non | — |
| 10 | 1.0 | 6.0 | 4.0 | 2.0 | 3.0 | 2.0 | remainder | Co-based | 10 | non | — |
| 11 | 1.0 | 6.0 | 4.0 | 2.0 | 3.0 | 2.0 | remainder | Co-based | 20 | non | — |
| 12 | 1.0 | 6.0 | 4.0 | 2.0 | 3.0 | 2.0 | remainder | *FeW-based | 40 | non | — |
| 13 | 1.0 | 6.0 | 4.0 | 2.0 | 3.0 | 2.0 | remainder | *FeMo-based | 40 | non | — |

*FeW- and FeMo- based hard particles are conventionally applied to the valve seat for the gasoline engine.

Investigation Method for the Wear and Abrasion Resistance

The valve seat obtained in accordance with each example was subject to a durability test with the use of a straight-type, four cycle, natural gas engine having four cylinders and displacement of 2000 cc. The test was carried out at 6000 rpm/WOT (full throttle) for 24 hour. A valve as the counterpart was formed of heat-resisting steel "SUH35" as a base material, and had a surface of valve face on which stellite overlay was formed. The wear and abrasion resistance was evaluated by measuring an amount of wear and abrasion after the durability test with respect to the valve and the valve seat on an exhaust port whose condition was severer than that of an intake port. Evaluation results are shown in Table 3 below.

TABLE 3

| | | Amount of Wear And Abrasion on Exhaust Port | |
|---|---|---|---|
| Number of EXAMPLE | | Valve Seat ($\mu$/Hr) | Valve ($\mu$/Hr) |
| Experiment Example | 1 | 0.48 | 0.13 |
| | 2 | 0.50 | 0.13 |
| | 3 | 0.43 | 0.14 |
| | 4 | 0.52 | 0.10 |
| | 5 | 0.39 | 0.14 |
| | 6 | 0.36 | 0.07 |
| | 7 | 0.38 | 0.07 |
| | 8 | 0.32 | 0.08 |
| Comparative Example | 9 | 0.63 | 0.13 |
| | 10 | 1.28 | 0.07 |
| | 11 | 0.76 | 0.10 |
| | 12 | 3.08 | 1.91 |
| | 13 | 2.68 | 1.68 |

In TABLE 3, according as the amount of the Cr and/or V is increased, the abrasion loss of the valve seat is decreased (i.e., EXAMPLE 9→1, 2 and 3) . In addition, according as the amount of the cobalt-based hard particles is increased, the abrasion loss of the valve seat is decreased (i.e., EXAMPLE 10→11→4→5) . TABLE 3 further shows the effect of the self-lubricating materials, namely, $CaF_2$ (i.e., EXAMPLE 5→6), MnS (i.e., EXAMPLE 5→7) and Pb infiltration (i.e., EXAMPLE 5→8). On the other hand, when the hard particles of FeW or FeMo conventionally used for the gasoline engine were added at 40 weight %, an excessive wear and abrasion was caused in the valve and the valve seat (i.e., EXAMPLES 12 and 13).

Explanation for Metallographic Structures

With respect to EXAMPLES 3, 5, 6, 7 and 13, photographs of metallographic structures are showed in FIGS. 1, 3, 5, 7 and 9 respectively. Photographing was performed under a condition of nital corrosion (4%) at 100 times of magnification.

Figure 2:
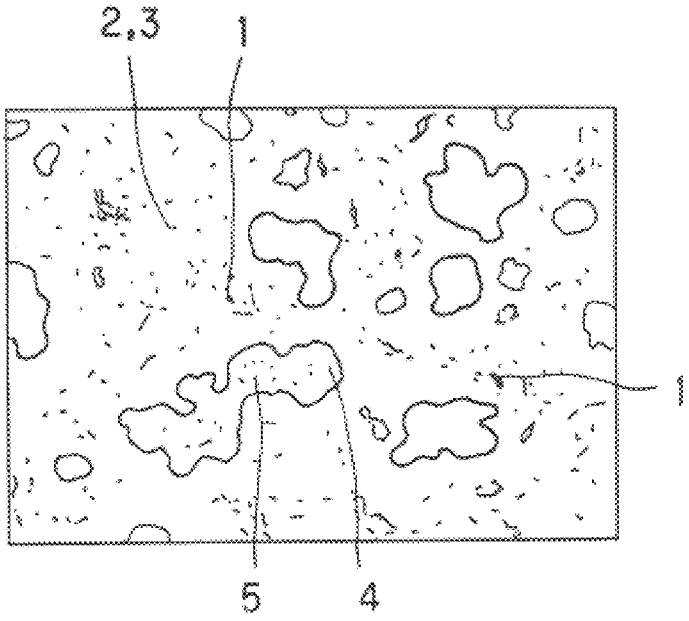
FIG. 2 is a schematic view explaining the photograph of FIG. 1.

The photograph of FIG. 1 (EXAMPLE 3 of the experiment example) is schematically shown in FIG. 2. In FIG. 1, small black dots express the pores 1; black areas express the pearlite phase 2, but partly express the martensite phase 3; a structure in which those two phases exist in a mixed state is also found; and, white areas express the highly alloyed phase 4. Besides, white spots express the cobalt-based hard particles 5, which are added to the base member at a ratio of 40 weight %, and dispersed therein.

Figure 3:
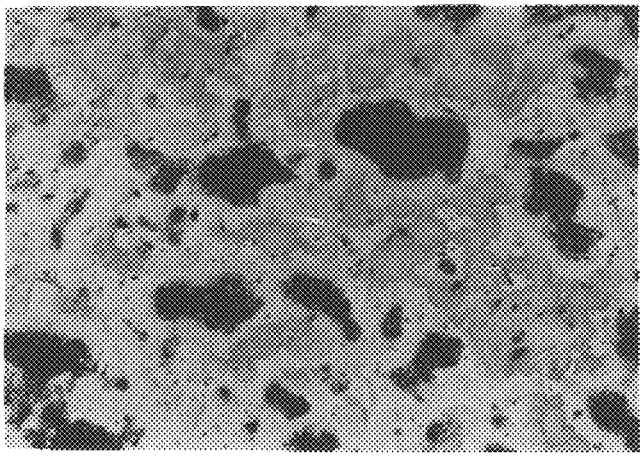
FIG. 3 is a photograph showing a metallographic structure of a valve seat obtained in Example 5 of the present invention.
Figure 4:
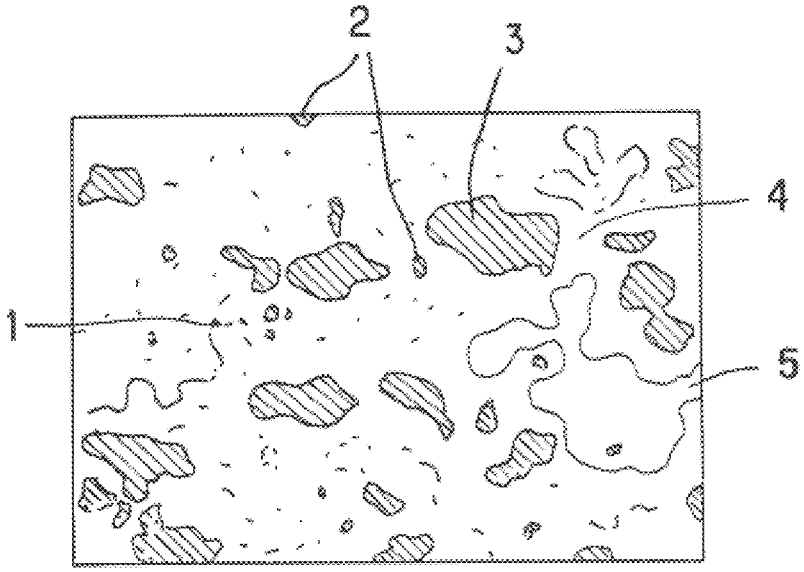
FIG. 4 is a schematic view explaining the photograph of FIG. 3.

The photograph of FIG. 3 (EXAMPLE 5 of the experiment example) is schematically shown in FIG. 4. In FIG. 3, small black dots express the pores 1; black areas express the pearlite phase 2, but partly express the martensite phase 3; and, white areas express the highly alloyed phase 4. Besides, white spots express the cobalt-based hard particles 5, which are added to the base member at a ratio of 40 weight %, and dispersed therein.

Figure 5:
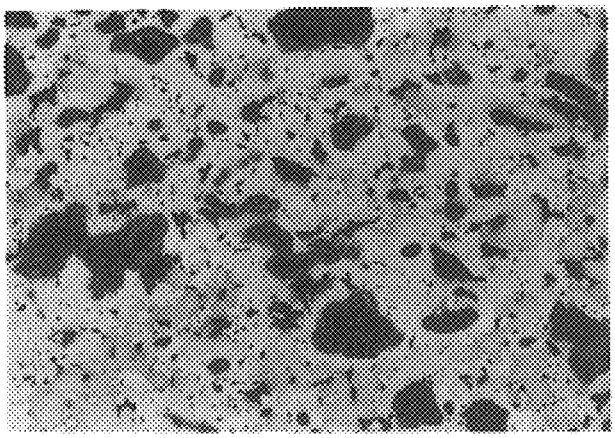
FIG. 5 is a photograph showing a metallographic structure of a valve seat obtained in Example 6 of the present invention.
Figure 6:
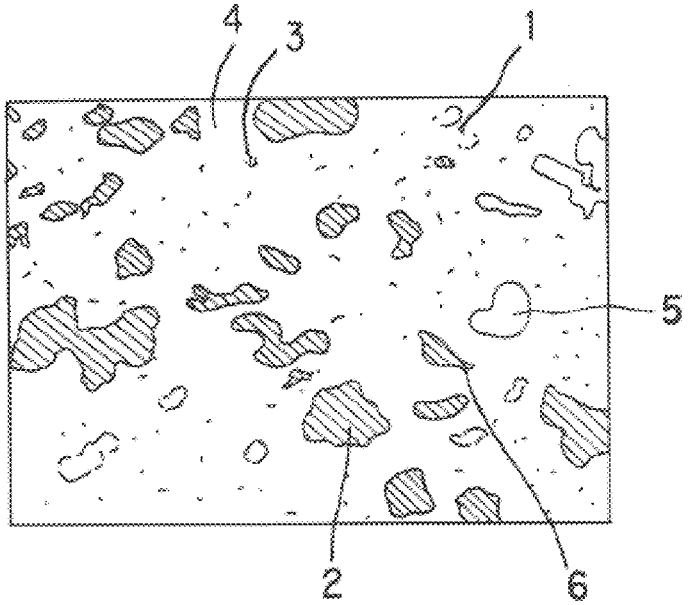
FIG. 6 is a schematic view explaining the photograph of FIG. 5.

The photograph of FIG. 5 (EXAMPLE 6 of the experiment example) is schematically shown in FIG. 6. In FIG. 5, small black dots express the pores 1; and another black dots larger than the pores express $CaF_2$ (6) as the self-lubricating material. The matrix in FIG. 5 has a structure in which the pearlite phase 2 ( black area ), the martensite phase 3 (also, black area) and the highly alloyed phase 4 (white area) exist in a mixed state. The cobalt-based hard particles 5 expressed as white spots are added to the base member at a ratio of 40 weight %, and dispersed therein.

Figure 7:
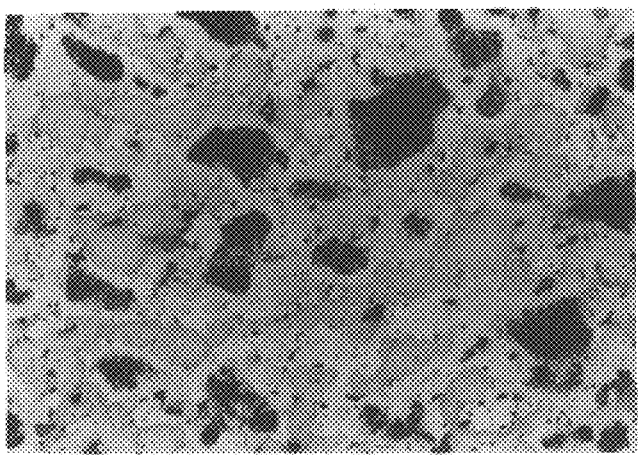
FIG. 7 is a photograph showing a metallographic structure of a valve seat obtained in Example 7 of the present invention.
Figure 8:
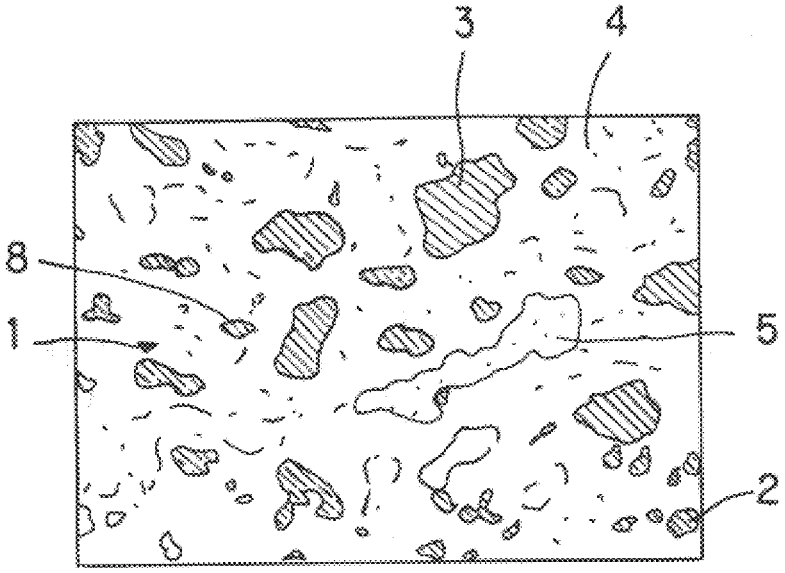
FIG. 8 is a schematic view explaining the photograph of FIG. 7.

The photograph of FIG. 7 (EXAMPLE 7 of the experiment example) is schematically shown in FIG. 8. In FIG. 7, small black dots express the pores 1; and gray dots larger than the pores express MnS (8) as the self-lubricating material. The matrix in FIG. 7 has a structure in which the pearlite phase 2 (black area), the martensite phase 3 (also, black area) and the highly alloyed phase 4 (white area) exist in a mixed state. The cobalt-based hard particles 5 expressed as white spots are added to the base member at a ratio of 40 weight %, and dispersed therein.

Figure 9:
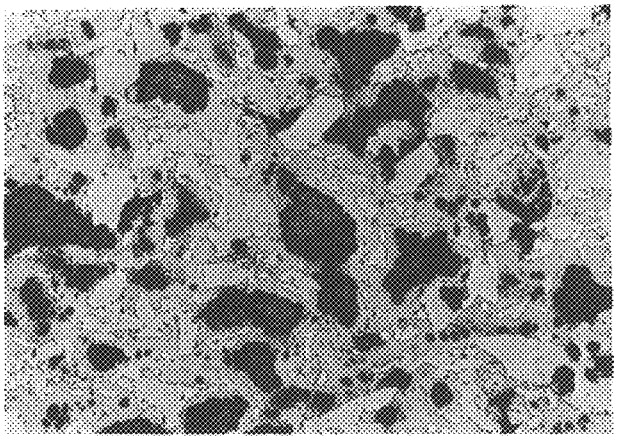
FIG. 9 is a photograph showing a metallographic structure of a valve seat obtained in Example 13 as a comparative example.
Figure 10:
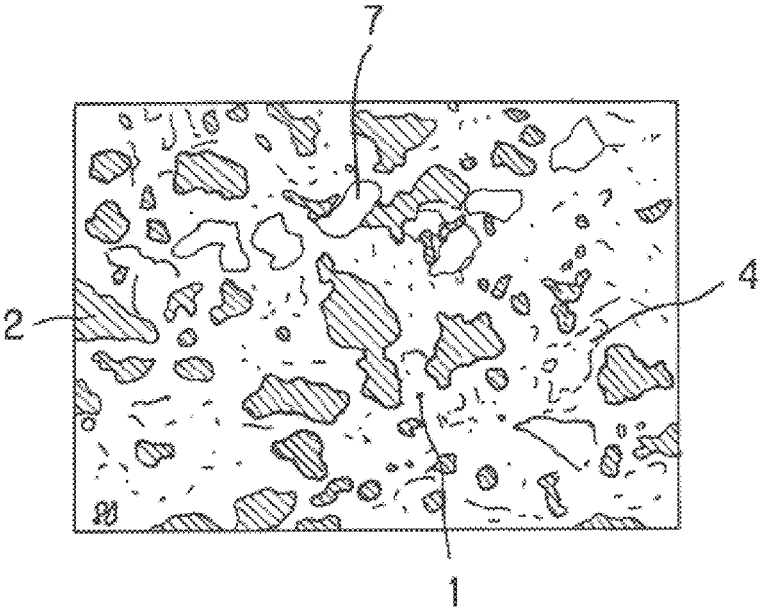
FIG. 10 is a schematic view explaining the photograph of FIG. 9.

The photograph of FIG. 9 (EXAMPLE 13 as the comparative example) is schematically shown in FIG. 10. The matrix in FIG. 9 has a structure in which the pearlite phase 2 (black area) and the highly alloyed phase 4 (white area) exist in a mixed state. Another white portions express Fe-Mo hard particles 7, which are added to the base member at a ratio of 40 weight %, and dispersed therein.

As the valve seat of the present invention for the internal combustion engine has a remarkably small attacking property against the counterpart as well as an excellent wear and abrasion resistance, it is preferably applied to various internal combustion engines. Particularly, the valve seat of the present invention is preferably applied to an internal combustion engine which is subjected to a severe operating condition such as the engine liable to cause the wear and abrasion through a direct contact between the metallic surfaces, as in the gaseous fuel-engine.

What is claimed is:

1. A valve seat for an internal combustion engine using a gaseous fuel provided with a base member, wherein said base member comprises;

a matrix of an iron-based alloy comprising (a) carbon in a range of 0.5–1.5 weight %, (b) at least one element selected from the group consisting of chromium and vanadium in a range of 0.5–10.0 weight % in total and (c) iron as a remainder of said matrix based on weight of said base member respectively, wherein cobalt-based hard particles are dispersed in said matrix in a range of 26–50 weight % based on weight of said base member.

2. A valve seat for an internal combustion engine as claimed in claim 1, wherein said matrix further comprises (d) at least one element selected from the group consisting of nickel, cobalt and molybdenum in a range of 2.0–20.0 weight % in total based on weight of said base member.

3. A valve seat for an internal combustion engine as claimed in claim 1 or 2, wherein said matrix is iron-based sintered alloy.

4. A valve seat for an internal combustion engine as claimed in claim 3, wherein said matrix is formed from a powdery raw material selected from the group consisting of (1) low alloyed powder containing elements as components of said matrix and (2) mixture of iron powder and each powder of elements as components of said matrix other than iron, and has a structure in which pearlite, martensite and a highly alloyed phase exist in a mixed state.

5. A valve seat for an internal combustion engine as claimed in claim 3, wherein said base member has a porosity in a range of 2–20% and whose pores are infiltrated with metal having a low melting point.

6. A valve seat for an internal combustion engine as claimed in claim 1 or 2, wherein said base member further comprises a self-lubricating material dispersed in said matrix.

7. A valve seat for an internal combustion engine using a gaseous fuel provided with a base member, wherein said base member comprises;

a porous matrix of an iron-based sintered alloy consisting essentially of (a) carbon in a range of 0.5–1.5 weight %, (b) at least one element selected from the group consisting of chromium and vanadium in a range of 0.5–10.0 weight % in total and (c) iron as a remainder of said matrix based on weight of said base member respectively, wherein cobalt-based hard particles are dispersed in said matrix in a range of 26–50 weight % based on weight of said base member.

8. A valve seat for an internal combustion engine using a gaseous fuel provided with a base member, wherein said base member comprises:

a porous matrix of an iron-based sintered alloy consisting essentially of (a) carbon in a range of 0.5–1.5 weight %, (b) at least one element selected from the group consisting of chromium and vanadium in a range of 0.5–10.0 weight % in total, (c) iron as a remainder of said matrix, and (d) at least one element selected from the group consisting of nickel, cobalt and molybdenum in a range of 2.0–20.0 weight % in total based on weight of said base member, respectively wherein cobalt-based hard particles are dispersed in said matrix in a range of 26–50 weight % based on weight of said base member.

* * * * *